US012416117B2

(12) United States Patent
Kwak et al.

(10) Patent No.: US 12,416,117 B2
(45) Date of Patent: Sep. 16, 2025

(54) FIBER COATING METHOD

(71) Applicant: MACSUMSUK GM CO., LTD., Yeongcheon-si (KR)

(72) Inventors: Sung Gun Kwak, Yeongcheon-si (KR); Da Eun Kwac, Busan (KR)

(73) Assignee: MACSUMSUK GM CO., LTD., Yeongcheon-si (KR)

( * ) Notice: Subject to any disclaimer, the term of this patent is extended or adjusted under 35 U.S.C. 154(b) by 0 days.

(21) Appl. No.: 18/562,231

(22) PCT Filed: Dec. 22, 2022

(86) PCT No.: PCT/KR2022/021102
§ 371 (c)(1),
(2) Date: Nov. 17, 2023

(87) PCT Pub. No.: WO2024/025057
PCT Pub. Date: Feb. 1, 2024

(65) Prior Publication Data

US 2025/0092600 A1 Mar. 20, 2025

(30) Foreign Application Priority Data

Jul. 27, 2022 (KR) ..... 10-2022-0092861

(51) Int. Cl.
*D06M 23/08* (2006.01)
*D06M 11/36* (2006.01)

(52) U.S. Cl.
CPC ..... *D06M 23/08* (2013.01); *D06M 11/36* (2013.01)

(58) Field of Classification Search
CPC ..... D06M 23/08; D06M 11/36
See application file for complete search history.

(56) References Cited

FOREIGN PATENT DOCUMENTS

| | | | |
|---|---|---|---|
| CN | 108004761 | A | 5/2018 |
| CN | 211945745 | U | 11/2020 |
| JP | 2001-234467 | A | 8/2001 |
| KR | 10-2006-0115115 | A | 11/2006 |
| KR | 10-0668105 | B1 | 1/2007 |
| KR | 10-0933138 | B1 | 12/2009 |
| KR | 10-2010-0078565 | A | 7/2010 |
| KR | 10-1034698 | B1 | 5/2011 |
| KR | 10-2015-0007681 | A | 1/2015 |
| KR | 10-1858658 | B1 | 5/2018 |
| KR | 10-1907688 | B1 | 10/2018 |
| KR | 10-1975955 | B1 | 5/2019 |
| KR | 10-2097714 | B1 | 4/2020 |
| TW | 200636116 | A | 10/2006 |

*Primary Examiner* — Robert S Walters, Jr.
(74) *Attorney, Agent, or Firm* — You & IP, LLC

(57) ABSTRACT

The present invention relates to a method of coating fibers with macsumsuk or clay minerals, in which wet mixed pulverization is performed by using the macsumsuk or the clay minerals, silicate zirconia, nano silver, yucca extracts, and the like as raw materials, granules are produced by a dry method, dry pulverization is performed, and the resultant is mixed with a solvent to coat the fabric. Therefore, a coating layer is hardly separated even if the number of uses increases, and deodorization performance can be maintained.

3 Claims, 6 Drawing Sheets

119

TEST REPORT

TEST REPORT NO.: CT20-007021K

7. TEST RESULT

| TEST ITEMS | | TEST METHOD | TEST RESULT | | | TEST ENVIRONMENT |
|---|---|---|---|---|---|---|
| | | | INITIAL CONCENTRATION (CFU/mL) | CONCENTRATION AFTER 24 HOURS (CFU/mL) | REDUCTION RATE (%) | |
| ANTIBACTERIAL TEST: ESCHERICHIA COLI | BLANK | KCL-FIR-1003 :2018 | $3.9\times10^5$ | $7.0\times10^6$ | - | (37.0±0.2)℃ |
| | WELLION SHEET | | $3.9\times10^5$ | $6.1\times10^4$ | 99.1 | |
| ANTIBACTERIAL TEST: STAPHYLOCOCCUS AUREUS | BLANK | | $3.0\times10^5$ | $5.9\times10^5$ | - | |
| | WELLION SHEET | | $3.0\times10^5$ | $2.0\times10^5$ | 96.6 | |

※ CFU: Colony Forming Unit

※ INOCULUM CONCENTRATION (CFU/mL): ESCHERICHIA COLI: $3.9\times10^5$, STAPHYLOCOCCUS AUREUS: $3.0\times10^5$ ※ STRAINS USED: *Escherichia coli* ATCC 8739

*Staphylococcus aureus* ATCC 6538P

※ TEST SPECIMEN : 5cm×5cm, CONTROL SPECIMEN : Stomacher film 5cm×5cm

※ TEST PLACE: ROOM 108, HANKYONG INDUSTRY ACADEMIC COLLABORATION BUILDING, 327, JUNGANG-RO, ANSEONG-SI, GYEONGGI-DO

FIG. 3

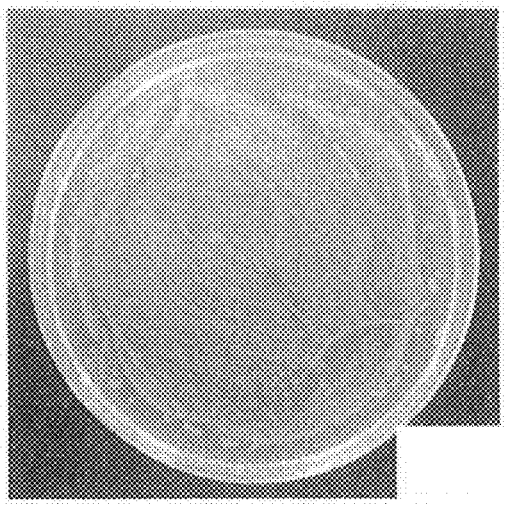
<PHOTO 1. ESCHERICHIA COLI - BLANK (24h)>
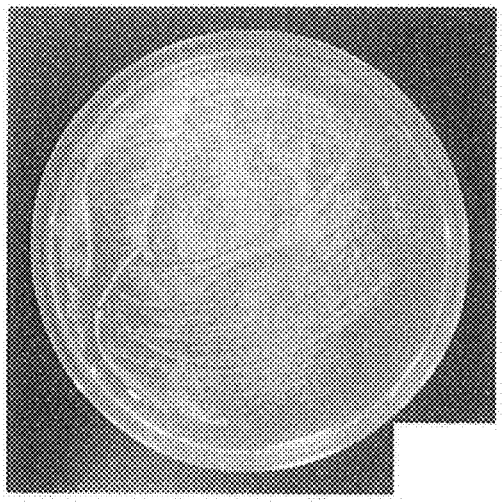
<PHOTO 3. STAPHYLOCOCCUS AUREUS - BLANK (24h)>
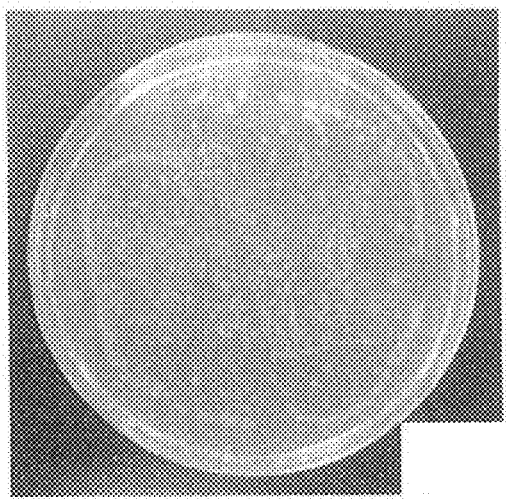
<PHOTO 2. ESCHERICHIA COLI - WELLION SHEET (24h)>
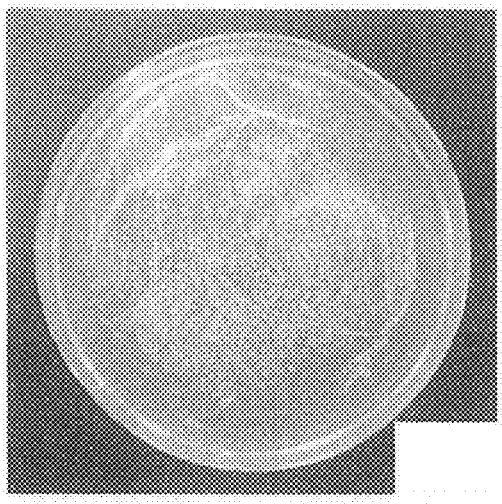
<PHOTO 4. STAPHYLOCOCCUS AUREUS - WELLION SHEET (24h)>
FIG. 4

TEST REPORT NO.: CT21-032687K

7. TEST RESULT

| TEST ITEM | | UNIT | TEST METHOD | TEST RESULT | | | TEST ENVIRONMENT |
|---|---|---|---|---|---|---|---|
| | | | | BLANK CONCENTRATION (μmol/mol) | SAMPLE CONCENTRATION (μmol/mol) | CONCENTRATION REDUCTION RATE (%) | |
| DEODORIZATION TEST AMMONIA $NH_3$ | 0 MIN | % | (1) | 50 | 50 | 0.0 | (21.3±0.5)°C (45.5±1.0)%R.H. |
| | 30 MIN | % | | 42 | <0.2 | 99.5 | |
| | 60 MIN | % | | 40 | <0.2 | 99.5 | |
| | 90 MIN | % | | 39 | <0.2 | 99.5 | |
| | 120 MIN | % | | 38 | <0.2 | 99.5 | |

※ DETECTION LIMIT 0.2μmol/mol

- Countinued on next page -

TEST REPORT NO.: CT21-032687K

7. TEST RESULT

| TEST ITEM | | UNIT | TEST METHOD | TEST RESULT | | | TEST ENVIRONMENT |
|---|---|---|---|---|---|---|---|
| | | | | BLANK CONCENTRATION (μmol/mol) | SAMPLE CONCENTRATION (μmol/mol) | CONCENTRATION REDUCTION RATE (%) | |
| DEODORIZATION TEST HYDROGEN SULFIDE $H_2S$ | 0 MIN | ※ | ( ) | 50 | 50 | 0.0 | (21.0±0.5) °C (45.3±0.8) %R.H. |
| | 30 MIN | ※ | | 49 | 30 | 38.8 | |
| | 60 MIN | ※ | | 49 | 28 | 42.9 | |
| | 90 MIN | ※ | | 49 | 26 | 46.9 | |
| | 120 MIN | ※ | | 48 | 25 | 47.9 | |

※ DETECTION LIMIT 0.1μmol/mol

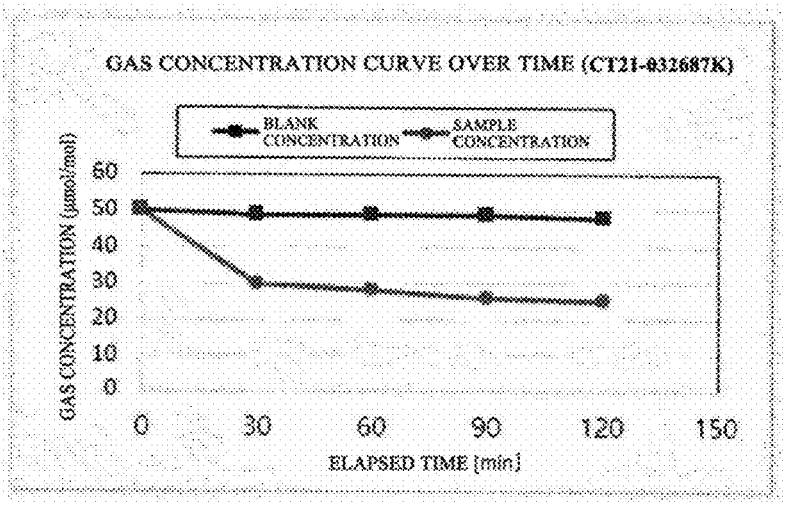

※ CLIENT SUGGESTION 1. 20 g OF THE SAMPLE PRESENTED BY THE CLIENT WAS PLACED IN A 5-L SIZE REACTOR AND SEALED.
2. THE INITIAL CONCENTRATION OF THE TEST GAS WAS INJECTED AT 50 μMOL/MOL OF AMMONIA AND HYDROGEN SULFIDE, AND THE CONCENTRATION OF THE TEST GAS WAS MEASURED AT THE INITIAL (0 MINUTES), 30 MINUTES, 60 MINUTES, 90 MINUTES, AND 120 MINUTES, WHICH IS CALLED THE SAMPLE CONCENTRATION.
3. THE CONCENTRATION OF THE TEST GAS WAS MEASURED BY A GAS DETECTION TUBE (SPS-KCLI2218-6218).
4. THE TEMPERATURE DURING THE TEST WAS MAINTAINED AT (23.0 ± 5.0)°C AND THE HUMIDITY WAS MAINTAINED AT (50 ± 10)% R.H.
5. APART FROM THIS, THE TEST WAS CONDUCTED ACCORDING TO 2 TO 4 ABOVE IN THE ABSENCE OF A SAMPLE, AND THIS IS CALLED BLANK CONCENTRATION.
6. THE CONCENTRATION REDUCTION RATE OF THE TEST GAS FOR EACH PERIOD OF TIME WAS CALCULATED BY THE FOLLOWING EXPRESSION.

CONCENTRATION REDUCTION RATE OF TEST GAS (%) = {(BLANK CONCENTRATION) - (SAMPLE CONCENTRATION)} / (BLANK CONCENTRATION)} × 100. END.

- Countinued on next page -

FIG. 6

FIBER COATING METHOD

TECHNICAL FIELD

The present invention relates to a method for coating fibers with macsumsuk or clay minerals.

BACKGROUND ART

Since fabrics for manufacturing mats, blankets, pads, clothing (mountain clothing), etc. are in contact with the user's body, a function to simply protect the user's body from the outside is required. In recent years, the application of various functions such as insulation, ventilation, waterproofing, and water repellency in addition to the above function has been required.

The inventor of the present application, as a person skilled in the art who mainly handles macsumsuk, has conducted a lot of research on the utilization of macsumsuk to meet these demands.

Macsumsuk consists of the components shown in Table 1 below.

TABLE 1

| Ingredient Name | Content (% by weight) |
|---|---|
| Silicon Dioxide ($SiO_2$) | 68.8 |
| Aluminum Oxide ($Al_2O_3$) | 12.99 |
| Iron Oxide ($Fe_2O_3$) | 2.47 |
| Calcium Oxide (CaO) | 1.99 |
| Magnesium Oxide (MgO) | 0.56 |
| Potassium Oxide ($K_2O$) | 4.53 |
| Sodium Oxide ($Na_2O$) | 6.25 |
| Titanium Dioxide ($TiO_2$) | 0.23 |
| Phosphorus Pentoxide ($P_2O_5$) | 0.06 |
| Manganese Oxide (MnO) | 0.06 |
| Others | Residual Quantity |

FIG. 1 illustrates an emissivity of the far-infrared rays of macsumsuk measured by KOREA FAR INFRARED ASSOCIATION. The unit of the emissivity in FIG. 1 is $W/m^2 \cdot \mu m$ based on the measurement at 70° C., and it can be confirmed that a high far-infrared emissivity similar to that of a black body is shown.

As such, in "a sleep bed with far-infrared radiation macsumsuk mattress" (Korean Patent Registration No. 10-1034698, Patent Literature 1) as a related technology for applying the function of macsumsuk to textile fabric products, macsumsuk, which has functions such as far-infrared emission, antibacterial, and deodorization, is applied to ceramic pieces, so that the beneficial functions of Macsumsuk can be applied to bedding.

In addition, in "a nonwoven fabric using macsumsuk powder mixture and silver and a manufacturing method thereof" (Korean Patent Registration No. 10-0933138, Patent Literature 2), a technique for coating macsumsuk powder on nonwoven fiber fabric has been provided.

In Patent Literature 1, macsumsuk powder is processed into very small pieces and applied to the fabric.

However, in recent years, adverse effects of nanoparticles on lung health have been reported. In addition, many opinions have been suggested that the application of larger-sized particles is better than that of the fine nanoparticles due to various factors such as the influence of the uniformity of particle distribution during processing thereof.

Accordingly, "a far-infrared ray-emitting and anion-emitting silicone rubber composition using macsumsuk granules and a manufacturing method therefor" (Korean Patent Registration No. 10-2097714, Patent Literature 3) and "a method for manufacturing antibacterial plastic master batch of macsumsuk granules" (Korean Patent Registration No. 10-1975955, Patent Literature 4) by means of the inventors of the present application have also suggested a technique of applying macsumsuk-based granules during rubber and plastic processing.

The rubber or plastic described above is easy to apply granulated macsumsuk to the manufacturing process. However, in the case of textiles, the thickness of the filament is very diverse, and recently, the filament is provided with a very thin thickness, so that it is difficult to directly apply macsumsuk granules to the production of yarn constituting the fiber fabric as in Patent Literature 3 and Patent Literature 4.

Therefore, it is desirable to apply a coating to the textile fabric. However, a technology for coating granulated macsumsuk on a fabric has not yet been developed.

PATENT LITERATURE

Patent Literature 1: Korean Patent Registration No. 10-1034698 (May 4, 2011)

Patent Literature 2: Korean Patent Registration No. 10-0933138 (Dec. 11, 2009)

Patent Literature 3: Korean Patent Registration No. 10-2097714 (Mar. 31, 2020)

Patent Literature 4: Korean Patent Registration No. 10-1975955 (Apr. 30, 2019)

DISCLOSURE

Technical Problem

The method of coating macsumsuk or clay minerals on fibers of the present invention is to solve the problems that occur in the related art as described above and provides a coating method that can smoothly apply macsumsuk or clay minerals to textiles (woven fabric).

More specifically, granules are prepared by using macsumsuk, clay minerals, zirconia silicate, yucca extracts, nano silver, and the like as raw materials, and then the granules are dry-pulverized and coated on textiles so that the granules can be easily applied to textiles.

Technical Solution

According to one aspect of the present invention so as to accomplish these objects, there is provided to a fiber coating method including: 1) a calcined mineral particle preparation step of preparing calcined mineral particles by preparing macsumsuk or clay minerals, pulverizing the macsumsuk or clay minerals to a size of 0.1 to 5 m/m, and calcining the pulverized macsumsuk or clay minerals at a temperature of 800 to 1,100° C.; 2) a mixing step of producing a mixture by preparing zirconia silicate ($ZrSiO_3$), nano silver, and yucca extracts and mixing the zirconia silicate ($ZrSiO_3$), the nano silver, and the yucca extracts with the calcined mineral particles; 3) a wet pulverization step of producing a slurry by adding water to the mixture and then performing wet mixed pulverizing with a ball mill; 4) a granule production step of producing granules by processing the slurry by a spray drying method with a granulator; 5) a dry pulverization step of producing granular powder by dry-pulverizing the produced granules to a size of 0.1 to 50 μm; 6) a coating step of mixing the granular powder with a urethane-based solvent and coating the fiber; 7) a surface treatment step of treating the surface by causing a surface of the fiber to which a coating process is completed to pass through a gravure roller; and 8) a laminating step of laminating TPU to adhere to the surface of the fabric to which the surface treatment is completed.

In the above configuration, in the mixing step, 90% to 98.8% by weight of the calcined mineral particles, 0.1% to 5% by weight of the zirconia silicate, 0.1% to 1% by weight of nano silver, and 1% to 4% by weight of yucca extracts are mixed.

In the above configuration, in the wet pulverization step, 20 to 50 parts by weight of water is added with respect to 100 parts by weight of the mixture.

Advantageous Effects

According to the present invention, a coating method capable of smoothly applying macsumsuk or clay minerals to textiles (woven fabric) is provided.

More specifically, granules are prepared by using macsumsuk, clay minerals, zirconia silicate, yucca extracts, nano silver, and the like as raw materials, and then the granules are dry-pulverized and coated on textiles so that the granules can be easily applied to textiles.

BRIEF DESCRIPTION OF DRAWINGS

The above and other objects, features and advantages of the present invention will be more apparent from the following detailed description taken in conjunction with the accompanying drawings, in which:

FIG. 3 is a test report according to Experimental Example 1.

FIG. 4 is photographs showing test results according to Experimental Example 1.

FIGS. 5 and 6 are test reports showing test results according to Experimental Example 2.

BEST MODE

Mode for Invention

Figure 1:
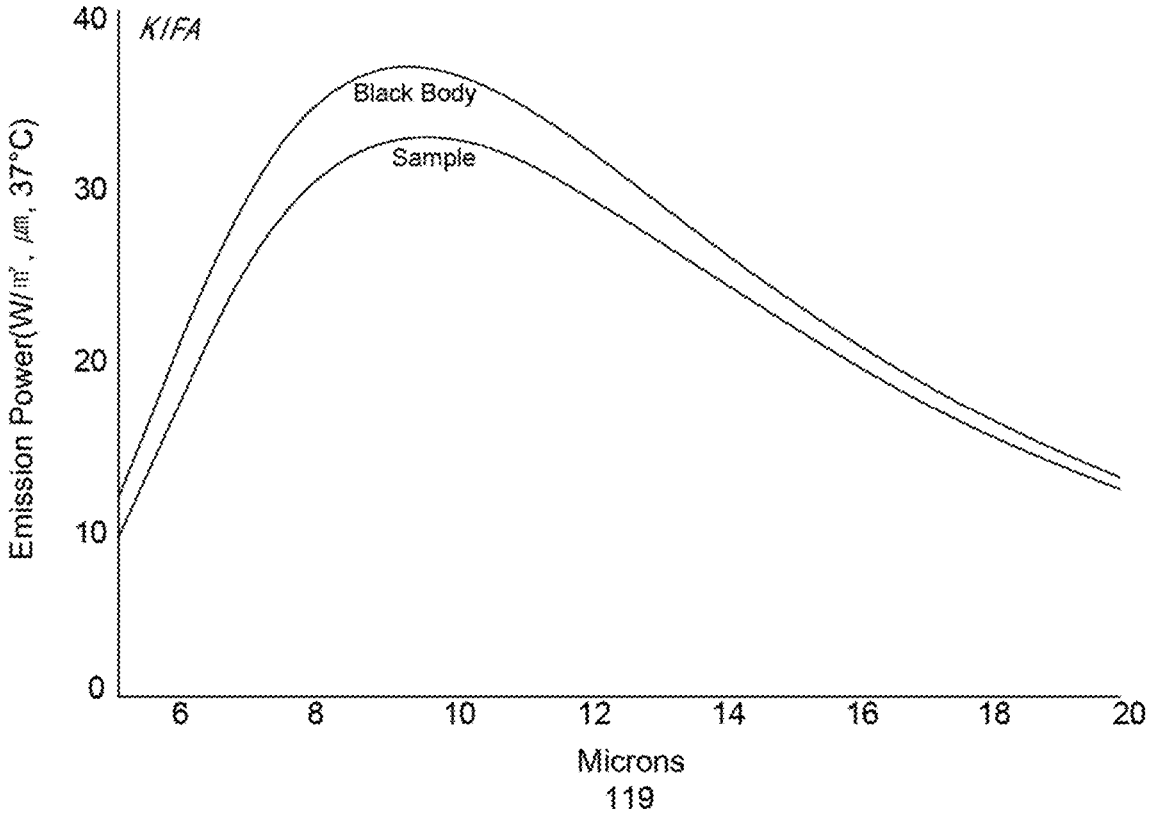
FIG. 1 is a graph showing the amount of far-infrared radiation of macsumsuk.

Hereinafter, a method of coating fibers with macsumsuk or clay minerals of the present invention is described in detail.

1) Calcined Mineral Particle Preparation Step

Macsumsuk or clay minerals were prepared, then ground to a size of 0.1 to 5 m/m, and calcined at a temperature of 800° C. to 1,100° C.

Macsumsuk includes the above-mentioned components, is a rock belonging to quartz porphyry among igneous rocks, and is characterized by being easily broken due to weathering as a whole. In particular, white feldspar is often kaolinized, and most biotite is oxidized and is scattered in the form of iron oxide.

Macsumsuk is characterized by containing a large amount of amphibole and includes a large amount of alumina oxide so that α-rays exist, and it is known that macsumsuk have a beneficial effect on living things.

The wavelength generated from macsumsuk is within the range of 8 to 14 μm, and macsumsuk is known as a mineral that emits far-infrared rays in wavelength ranges beneficial to the body.

The far-infrared rays in this wavelength range is known to activate living cells and promote metabolism.

Macsumsuk is pulverized based on the fact that the emissivity of far-infrared rays generated when macsumsuk is finely powdered is higher than the emissivity of far-infrared rays generated in a rocky state of macsumsuk.

In addition, the same processing is applied to clay minerals in addition to macsumsuk.

That is, macsumsuk and clay minerals may be prepared alone or prepared as mixture of the two, and the mixing ratio of the two may be a weight ratio of 1:0.1 to 5.

2) Mixing Step

Zirconia silicate ($ZrSiO_3$), nano silver, and yucca extracts are prepared and mixed with the calcined mineral particles to produce a mixture.

Zirconia silicate includes particles of about 10 to 100 μm, is allowed to permeate into fine pores between other raw materials or to be fixed into grooves of irregular surfaces to prevent the surface of granules from becoming uneven, and is allowed to be smooth and have increased strength.

Nano silver is an antibacterial material and allows antibacterial properties to be exhibited within the granules.

Yucca is a type of cactus that grows wild in desert areas from the southern United States to Central America, and Native Americans have used yucca for treatment and health purposes for a long time. Native Americans also have cooked flowers, fruits, seeds, stems, roots, and the like of yucca in various ways for food. For medical purposes, yucca has been effectively used to treat rheumatism and arthritis and has been used in a method of cutting the stems of yucca and boiling them with water to obtain liquid concentrates and feeding the liquid concentrates to an arthritis patient or applying the liquid concentrates to the joints. This method has been proven in modern science, and yucca is still being used as a treatment for arthritis in many countries around the world.

There has been a case where yucca extracts are applied to livestock feed, but there has been no case where yucca extracts are applied to textile coatings. According to the present invention, yucca extracts serve to deodorize a smell of the textiles itself, a smell that occurs after sweat, excretion, or the like comes into contact with the fabric, or the like.

The mixing ratio of raw materials for this purpose preferably includes 90% to 98.8% by weight of calcined mineral particles, 0.1% to 5% by weight of zirconia silicate ($ZrSiO_3$), 0.1% to 1% by weight of nano silver, and 1% to 4% by weight of yucca extracts.

TABLE 2

| Classification | Composition (% by weight) | |
|---|---|---|
| Calcined Mineral Particles | 98.8 | 90 |
| Zirconia Silicate ($ZrSiO_3$) | 0.1 | 5 |
| Nano Silver | 0.1 | 1 |
| Yucca Extract | 1 | 4 |
| Total | 100 | 100 |

In the composition, when the content of zirconia silicate ($ZrSiO_3$) is less than the minimum content, the texture of the textile is not smooth, and when the content exceeds the maximum content, the price of the fabric becomes too high.

If nano silver is included in less than the minimum content, the antibacterial function is deteriorated, and if the content exceeds the maximum content, the price of the fabric increases.

In the case of yucca extracts, if the content is less than the minimum content, the deodorizing effect is deteriorated, and if the content is excessive, it is not suitable because it has a specific odor.

The mixing of the raw materials according to the mixing step as described above is performed as shown in Table 3 below.

3) Wet Pulverization Step

After adding water to the mixture, a slurry is produced by wet mixed pulverization with a ball mill.

At this time, 20 to 50 parts by weight of water may be added with respect to 100 parts by weight of the mixture.

4) Granule Production Step

Granules are produced by processing the slurry by a spray drying method using a granulator.

More specifically, in the granule production, the hot air burner of the granulator is ignited to raise the temperature, the blower is operated in a state in which the internal temperature of the furnace is raised to 150° C. to 500° C. to move the heat to the inside of the cyclone, a nozzle is put into the lower part of the cyclone when the internal temperature reaches a certain temperature, and the slurry is raised to the top by using a high-pressure pump.

At this time, the spun liquid phase causes a vortex due to the hot air introduced from the upper side of the cyclone and falls, and the moisture contained in the raw material evaporates due to the internal heat, thereby obtaining granules having pores.

Figure 2:
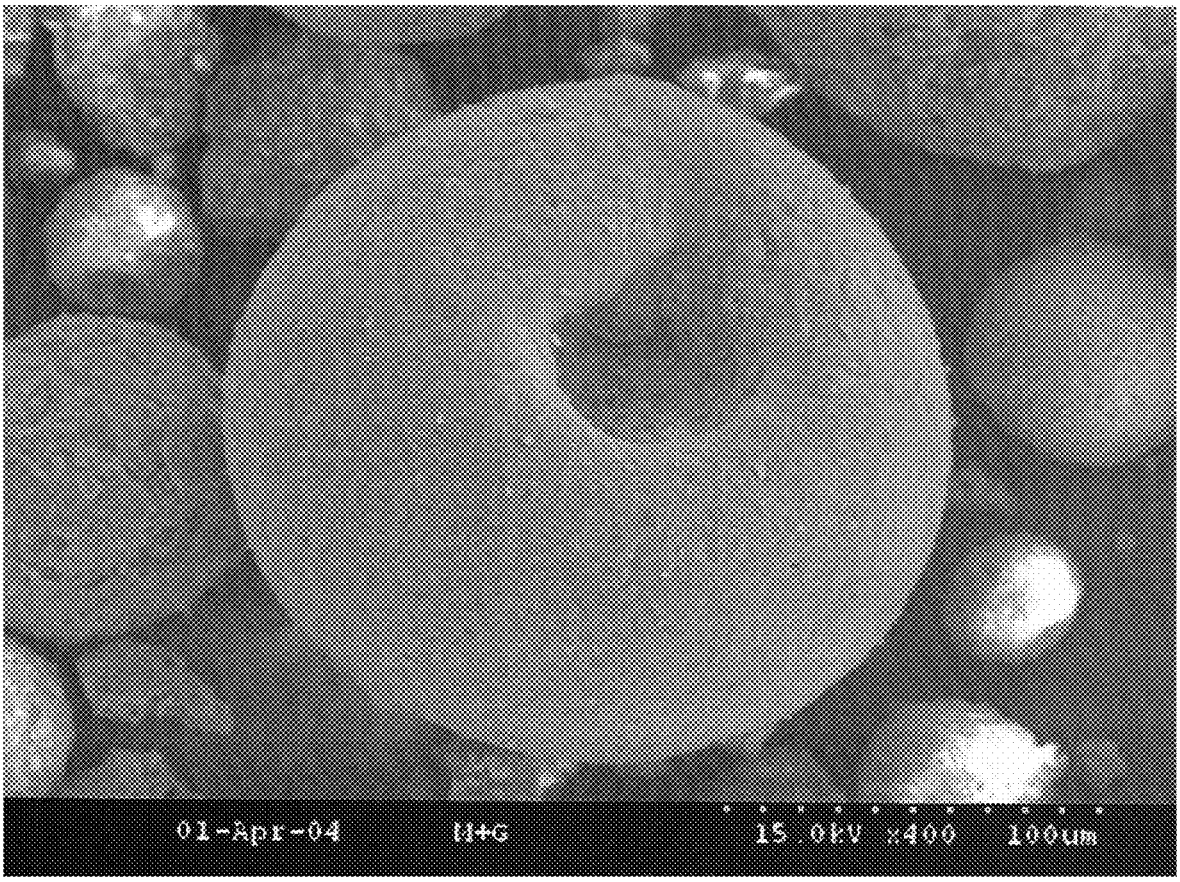
FIG. 2 is an electron microscope measurement picture showing the granules produced during the progress of the present invention.

FIG. 2 illustrates a micrograph of the granules produced in this manner.

As can be seen from the drawing, the moisture contained in the granules is rapidly vaporized from the inside, and the pressure is increased due to the temperature expansion of the bubbles formed at this time. When the pressure exceeds a certain level, it penetrates the spherical surface so that annular granules as shown in the drawing are formed.

The annular granules from which water vapor has escaped form small pores at places where water molecules have existed.

5) Dry-Pulverization Step

Granular powder is prepared by dry-pulverizing the produced granules into a size of 0.1 to 50 μm.

A pin crusher or a dry ball mill may be used for pulverization, and only granular powder having a size within the above range is selected through sieving after grinding.

The reason for carrying out the dry grinding process is because, if molded granules are applied to fabric as it is, the feeling of foreign matter on the surface of the fabric increases, and the molded granules may be easily separated from the fabric. Therefore, the particle size is reduced.

6) Coating Step

The granular powder and a urethane-based solvent are mixed and coated (printed) on fibers.

Examples of urethane-based solvents include thermoplastic polyurethane (TPU).

As the coating method, a well-known coating method in the related art may be applied, and a printing method may also be applied.

7) Surface Treatment Step

The fiber surface to which a coating process is completed is passed through a gravure roller to treat the surface.

When being passed through the gravure roller, the surface becomes smooth so that the water repellent effect is improved.

8) Laminating Step

Thermoplastic polyurethane (TPU) is laminated to adhere to the surface of the fabric to which the surface treatment is completed.

In this case, a waterproof effect can be obtained.

In the laminating step, a desired pattern and volume can be obtained by partially laminating after adding cotton or mesh to the fabric.

Hereinafter, Examples according to the present invention and Comparative Examples for comparison with the Examples are described.

Fabric Coating of Examples and Comparative Examples

Macsumsuk was pulverized to a size of 0.1 to 5 m/m and calcined at a temperature of 1,000° C. to prepare particles, and zirconia silicate selected to have a particle size of 10 to 100 μm, nano silver, and liquid yucca extract were prepared.

Then, a mixture was produced by mixing the raw materials in the mixing ratio shown in the table below.

TABLE 3

| Item | | A | B | C | D | Total |
|---|---|---|---|---|---|---|
| Example | 1 | 98.8 | 0.1 | 0.1 | 1 | 100 |
| | 2 | 90 | 5 | 1 | 4 | 100 |
| | 3 | 97.42 | 0.08 | 0.5 | 2 | 100 |
| | 4 | 92.3 | 5.2 | 0.5 | 2 | 100 |
| | 5 | 94.92 | 3 | 0.08 | 2 | 100 |
| | 6 | 93.8 | 3 | 1.2 | 2 | 100 |
| | 7 | 95.7 | 3 | 0.5 | 0.8 | 100 |
| | 8 | 92.3 | 3 | 0.5 | 4.2 | 100 |
| Comparative Example | 1 | 97.5 | 0 | 0.5 | 2 | 100 |
| | 2 | 95 | 3 | 0 | 2 | 100 |
| | 3 | 96.5 | 3 | 0.5 | 0 | 100 |

(A: Calcined Mineral Particles, B: Zirconia Silicate, C: Nano Silver, D: Yucca Extract)

Subsequently, 100 parts by weight of the mixture and 30 to 50 parts by weight of water with respect to 100 parts by weight of the mixture were mixed, and then wet mixed pulverization was performed with a ball mill to prepare a slurry.

Then, the slurry was fed into a granulator to which a spray-dray method was applied and processed to produce granules.

Subsequently, the produced granules were pulverized with a dry ball mill and selected to have a size of 0.1 to 50 μm to produce granular powder.

Subsequently, thermoplastic polyurethane (TPU) was prepared, mixed with granular powder and then coated on each of suede fabric, pure cotton, and cotton/50% polyester blended fabric.

Subsequently, the coated fabric was passed through a gravure roller to be subjected to a surface treatment, and then thermoplastic polyurethane (TPU) was laminated to adhere to the surface of the fabric on which the surface treatment was completed.

<Experimental Example 1> Antibacterial Test

The coated suede fabric according to Example 1 was commissioned for an antibacterial test at the Korea Conformity Laboratories.

The experimental method was based on KCL-FIR-1003: 2018, and as a result of the experiment, *Escherichia coli* and *Staphylococcus aureus* were inoculated and left for 24 hours in an environment around 37° C. to obtain a result of the reduction of 99.1% of *Escherichia coli* and the reduction of 96.6% of *Staphylococcus.*

FIG. 3 illustrates a test report, and FIG. 4 are photographs showing results according to the test results.

<Experimental Example 2> Deodorization Test

A sample of the granular powder in the production process of Example 1 was commissioned for a deodorization test to the Korea Conformity Laboratories.

As the experimental method, 20 g of the sample was put into a 5-liter reactor and sealed, gas was injected at an initial concentration of 50 μmol/mol, the concentration of the test gas was measured at 0, 30, 60, 90, and 120 minutes and was set as the sample concentration. The concentration of the test gas was measured in a gas detection tube (SPS-KCL12218-6218). During the test, the temperature was maintained at 23.0° C. and the relative humidity was maintained at 50%. Separately, the concentration was measured in the same way in the absence of a sample and was set as a blank.

The test gas concentration reduction rate for each period of time was calculated by the following equation.

$$\text{Concentration Reduction Rate of Test Gas (\%)} = \{(\text{Blank Concentration} - \text{Sample Concentration})/\text{Blank Concentration}\} \times 100$$

Figure 5:
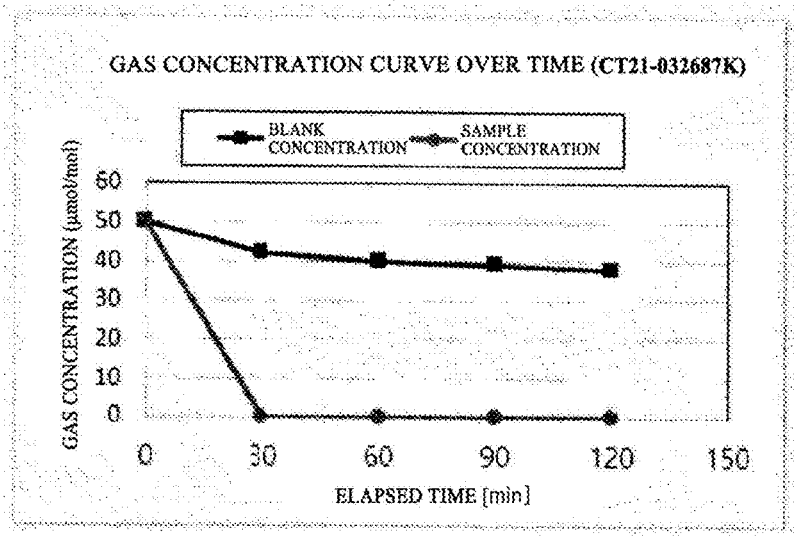

The test items were ammonia and hydrogen sulfide, and the experimental results are shown in FIGS. 5 and 6.

As a result of the experiment, it is understood that the sample concentration showed a 99.5% reduction rate after 30 minutes in the case of ammonia gas, and the concentration also decreased in the case of hydrogen sulfide.

<Experimental Example 3> Measurement of Degree of Peeling of Coating Layer According to Number of Washings The fabric of the Examples and the Comparative Examples was repeatedly washed and dried for 10 sheets of each type to measure the number of times of washing at which peeling of the coating layer began, and average values thereof were calculated and shown in Table 4 below.

TABLE 4

| Item | | Suede Fabric | Pure Cotton | Cotton/50% Polyester Blended Fabric |
|---|---|---|---|---|
| Example | 1 | 327 | 524 | 617 |
| | 2 | 352 | 547 | 662 |
| | 3 | 283 | 422 | 511 |
| | 4 | 252 | 417 | 499 |
| | 5 | 262 | 431 | 524 |
| | 6 | 277 | 452 | 522 |
| | 7 | 263 | 414 | 485 |
| | 8 | 284 | 469 | 517 |
| Comparative Example | 1 | 52 | 102 | 145 |
| | 2 | 43 | 89 | 132 |
| | 3 | 61 | 115 | 162 |

As shown in Table 4, it was found that the coating layer was preserved for a much longer period of time in Examples than in Comparative Examples when washing and drying were repeated.

<Experimental Example 4> Sensory Evaluation for Touch (Smoothness)

Ten experts were selected to evaluate the texture for each type of fabric for the coated fabrics of the Examples and Comparative Examples, and the average value of the texture was calculated and shown in Table 5 below.

TABLE 5

| Item | | Suede Fabric | Pure Cotton | Cotton/50% Polyester Blended Fabric |
|---|---|---|---|---|
| Example | 1 | ◎ | ◎ | ◎ |
| | 2 | ◎ | ◎ | ◎ |
| | 3 | ○ | ○ | ○ |
| | 4 | ○ | ○ | ○ |
| | 5 | ○ | ○ | ○ |
| | 6 | ○ | ○ | ○ |
| | 7 | ○ | ○ | ○ |
| | 8 | ○ | ○ | ○ |
| Comparative Example | 1 | x | Δ | x |
| | 2 | x | x | x |
| | 3 | x | x | Δ |

* Evaluation Criteria: (◎: Very Smooth, ○: Somewhat Smooth, Δ: Normal, x: Rough)

As shown in Table 5, it was found that the fabric of Examples had a better touch than that of Comparative Examples.

<Experimental Example 5> Sensory Evaluation of Touch after Washing

Ten experts were selected to compare the touch of the coated fabric of the Examples and the Comparative Examples immediately after production and after washing 20 times for each type of fabric.

The touch was evaluated, and the average values of the touch were calculated and shown in Tables 6 to 8 below.

TABLE 6

<Suede Fabric>

| Item | | Initial Touch | After Washing 20 Times |
|---|---|---|---|
| Example | 1 | 4.75 | 4.63 |
| | 2 | 4.77 | 4.65 |
| | 3 | 4.23 | 3.45 |
| | 4 | 4.11 | 3.32 |
| | 5 | 3.98 | 3.11 |
| | 6 | 4.21 | 3.54 |
| | 7 | 4.11 | 3.45 |
| | 8 | 3.95 | 3.23 |
| Comparative Example | 1 | 2.7 | 1.2 |
| | 2 | 2.5 | 1.1 |
| | 3 | 2.4 | 1.3 |

TABLE 7

<Pure Cotton Fabric>

| Classification | | Initial Touch | After Washing 20 Times |
|---|---|---|---|
| Example | 1 | 4.51 | 4.4 |
| | 2 | 4.62 | 4.51 |
| | 3 | 4.17 | 3.51 |
| | 4 | 4.05 | 3.40 |
| | 5 | 3.77 | 3.23 |
| | 6 | 4.10 | 3.47 |
| | 7 | 4.01 | 3.35 |
| | 8 | 3.55 | 3.0 |
| Comparative Example | 1 | 2.6 | 1.0 |
| | 2 | 2.7 | 1.1 |
| | 3 | 2.5 | 1.2 |

TABLE 8

| <Cotton/50% Polyester Blended Fabric> | | | |
|---|---|---|---|
| Item | | Initial Touch | After Washing 20 Times |
| Example | 1 | 4.78 | 4.62 |
| | 2 | 4.69 | 4.51 |
| | 3 | 4.21 | 3.57 |
| | 4 | 4.15 | 3.65 |
| | 5 | 4.21 | 3.62 |
| | 6 | 4.08 | 3.48 |
| | 7 | 4.19 | 3.57 |
| | 8 | 4.12 | 3.61 |
| Comparative Example | 1 | 2.9 | 1.1 |
| | 2 | 2.9 | 1.2 |
| | 3 | 2.8 | 1.2 |

* Evaluation criteria: (5: Very Good, 4: Good, 3: Average, 2: Bad, 1: Very Bad)

As shown in Tables 6 to 8, it was found that the fabric of the Examples showed little difference in touch between the initial touch and the touch after 20 washings, whereas the Comparative Examples had much worse touch.

<Experimental Example 5> Test for Measuring Change in Deodorization Performance Before and After Washing 28% volume concentration of ammonia water was diluted with 4 times the volume of water to produce a diluted solution, and 0.15 cc of the diluted solution was put into a 300 cc Erlenmeyer flask so that the ammonia concentration was 160 ppm. Then, the fabric (suede fabric) of the Examples and the Comparative Examples were cut, 20 g of each specimen was added, 5 cc of the test solution was added, sealed, and allowed to stand, the odor source concentrations were measured after 60 minutes for after 3 and 60 minutes, and the deviation thereof was calculated.

At this time, the respective deviations for the samples immediately after production and the samples after repeated washing and drying for 20 times are shown in Table 9 below.

Concentration Deviation=Concentration After 3 Minutes−Concentration After 60 Minutes

TABLE 9

| | | Samples Immediately After Production | | | Fabric After Repeated Washing and Drying 20 Times | | |
|---|---|---|---|---|---|---|---|
| Item | | Conc. after 3 Minutes (ppm) | Conc. after 60 Minutes (ppm) | Conc. Deviation | Conc. after 3 Minutes (ppm) | Conc. after 60 Minutes (ppm) | Conc. Deviation |
| Example | 1 | 89 | 24 | 65 | 90 | 28 | 62 |
| | 2 | 91 | 27 | 64 | 92 | 29 | 63 |
| | 3 | 91 | 35 | 56 | 92 | 43 | 49 |
| | 4 | 90 | 37 | 53 | 91 | 44 | 47 |
| | 5 | 89 | 34 | 55 | 92 | 43 | 49 |
| | 6 | 90 | 33 | 57 | 91 | 45 | 46 |
| | 7 | 91 | 33 | 58 | 90 | 43 | 47 |
| | 8 | 88 | 34 | 54 | 89 | 44 | 45 |
| Comparative Example | 1 | 92 | 62 | 30 | 92 | 78 | 14 |
| | 2 | 91 | 61 | 30 | 91 | 82 | 9 |
| | 3 | 92 | 59 | 33 | 93 | 85 | 8 |

As shown in Table 9, the fabrics of the Examples immediately after production or after washing and drying for 20 times were similar to each other with large concentration deviations, but in the case of the Comparative Examples, the concentration deviations immediately after production were smaller than those in the Examples, and also the concentration deviation was only 8 when washing and drying were performed 20 times, indicating that the deodorization performance was almost lost.

The invention claimed is:

1. A fabric coating method comprising:

1) A calcined mineral particle preparation step of preparing calcined mineral particles by preparing macsumsuk or clay minerals, pulverizing the macsumsuk or clay minerals to a size of 0.1 to 5 mm, and calcining the pulverized macsumsuk or clay minerals at a temperature of 800 to 1,100° C.;

2) A mixing step of producing a mixture by preparing zirconia silicate ($ZrSiO_3$), nano silver, and yucca extracts and mixing the zirconia silicate ($ZrSiO_3$), the nano silver, and the yucca extracts with the calcined mineral particles;

3) A wet pulverization step of producing a slurry by adding water to the mixture and then performing wet mixed pulverizing with a ball mill;

4) a granule production step of producing granules by processing the slurry by a spray drying method with a granulator;

5) a dry pulverization step of producing granular powder by dry-pulverizing the produced granules to a size of 0.1 to 50 μm;

6) a coating step of mixing the granular powder with a urethane-based solvent and coating a fabric;

7) a surface treatment step of treating a surface by causing a surface of the coated fabric to pass through a gravure roller; and 8) a laminating step of laminating thermoplastic polyurethane (TPU) to adhere to the surface of the fabric to which the surface treatment is completed.

2. The fabric coating method according to claim 1, wherein in the mixing step, 90% to 98.8% by weight of the calcined mineral particles, 0.1% to 5% by weight of the zirconia silicate, 0.1% to 1% by weight of nano silver, and 1% to 4% by weight of yucca extracts are mixed.

3. The fabric coating method according to claim 2, wherein, in the wet pulverization step, 20 to 50 parts by weight of water is added with respect to 100 parts by weight of the mixture.

* * * * *